US005335962A

United States Patent [19]

Gera

[11] Patent Number: 5,335,962

[45] Date of Patent: Aug. 9, 1994

[54] SECTIONAL SOFA

[75] Inventor: Robert A. Gera, Glencoe, Ill.

[73] Assignee: Universal Furniture Industries, Inc., High Point, N.C.

[21] Appl. No.: 942,594

[22] Filed: Sep. 9, 1992

[51] Int. Cl.[5] ..... A47C 15/00

[52] U.S. Cl. ..... 297/232; 297/188; 297/135; D6/336; D6/397

[58] Field of Search ..... 297/232, 248, 233, 254, 297/157, 135, 188; D6/335, 336, 378, 381, 396, 397; 108/25, 64, 92

[56] References Cited

U.S. PATENT DOCUMENTS

| | | | |
|---|---|---|---|
| D. 155,624 | 10/1949 | Pahlmann | 297/135 X |
| D. 162,492 | 3/1951 | Tarlazzi | D15/11 |
| D. 181,845 | 1/1958 | Frey | D5/4 |
| D. 237,328 | 10/1975 | Vogt | D6/45 |
| D. 245,951 | 10/1977 | Lande | D6/46 |
| D. 298,784 | 12/1988 | Friedman | D6/335 |
| D. 327,374 | 6/1992 | Perez | D6/336 |
| D. 332,879 | 2/1993 | Gera | D6/336 |
| 797,826 | 8/1905 | Sherman, Jr. | 297/232 X |
| 2,285,778 | 6/1942 | Milward | 108/92 X |
| 5,064,244 | 11/1991 | Sproule | 297/85 X |

FOREIGN PATENT DOCUMENTS

| | | | |
|---|---|---|---|
| 3512581 | 10/1986 | Fed. Rep. of Germany | 297/232 |
| 3625225 | 2/1988 | Fed. Rep. of Germany | 297/232 |
| 0028820 | of 1902 | United Kingdom | 297/248 |

*Primary Examiner*—Kenneth J. Dorner
*Assistant Examiner*—Milton Nelson, Jr.
*Attorney, Agent, or Firm*—Pravel, Hewitt, Kimball & Krieger

[57] ABSTRACT

A modular upholstered sofa arrangement includes a plurality of seating units (e.g. chairs, recliners) and one or more wedge-shaped modular furniture units between adjacent seating units. The wedge shaped units extend upwardly to a maximum elevation of about the top elevation of the seating units. The wedge shaped members provide multiple table surfaces for storing or displaying articles. The lower table is movable between open and closed positions to provide access/closure to a storage compartment under the lower table.

35 Claims, 3 Drawing Sheets

SECTIONAL SOFA

BACKGROUND OF THE INVENTION

1. Field of the Invention

The present invention relates to modular upholstered furniture and more particularly relates to a modular or sectional upholstered sofa seating arrangement having a plurality of modular upholstered seating units in combination with one or more wedge-shaped modular furniture units that are positioned between the seating units wherein each of the wedge-shaped units provides multiple tables at differing elevations and of differing sizes for storing articles on the table surfaces and in hidden spaces under one or more of the table surfaces.

2. General Background

Sectional sofas and modular sofas typically include a number of separate seating units such as for example chairs, sofas, loveseats, recliners, and the like. The end seating unit usually has an arm at the end such as a recliner positioned at the end of the sectional or modular sofa. The interior seating areas can be without arms so as to form a continuous seating surface with adjacent modular units.

There have been numerous sectional sofas that include one or more table units as part of the sectional sofa. Some of these sectional sofa arrangements with tables have been the subject of patents.

An example of a modular sofa with tables can be seen in U.S. Pat. No. Des. 282,886 entitled "Combined Sectional Sofa and Multiple Table Unit" issued to David Williams. The Williams patent shows a combined sectional sofa and multiple table units wherein the seating units include chairs having arms, a flat upholstered seat area, and an upstanding rear sofa back that is upholstered. The Williams patent also shows entire sofa seating units having arms and multiple seat cushions as well as corresponding seat back portions. In the Williams patent, the multiple table members include end tables that are generally rectangular and wedge-shaped tables that have edge surfaces arranged ninety degrees with respect to one another.

Another sectional sofa with tables positioned between seating units is seen in the Friedman patent entitled "Combined Table and Sectional Sofa Unit". In the Friedman patent, some of the seating areas are chairs that do not have arms. The armless chairs are combined with recliners that have one arm so that the armless seating units and recliners form a continuous seating surface. A wedge-shaped table is positioned between armless chair seating units, the table having side edges that are approximately ninety degrees with respect to one another.

In the Lande, U.S. Pat. No. Des. 245,951 entitled "Combined Sectional Sofa and Multiple Table Unit", there is shown a plurality of seating units including a pair of seating units having arms, seat cushions and back portions and a pair of tables of a wedge configuration wherein the side edge portions of the tables form acute angles. An armless center chair is positioned between a pair of the wedge-shaped tables and upholstered seating units having arms are positioned on each side of a respective wedge-shaped table and opposite the armless chair unit.

In the Pohlheim et al., U.S. Pat. No. D 237,328 entitled "Combined Table and Seating Unit", there is seen a pair of chairs having arms on each side of each chair. The arms of adjacent chairs support a wedge-shaped table such that the top surface of the table is at the same elevation as the top surface of each of the arms of the respective chairs.

A combined sofa bed and table unit is seen in U.S. Pat. No. D 181,845 which shows a pair of spaced apart sofas positioned on opposite sides of a table that extends above the surface of the seat cushion of each sofa and below the top surface of the sofa back. The table is trapezoidally shaped, having opposed edge surfaces that form an acute angle with one another.

In the use of modular sofas, it is important that each of the users of the sofa have a good view of the focal point of a room such as the television set, picture window, fireplace, or the like. Further, it is important that a sectional sofa have an aesthetically pleasing look so that tables interfaced with the sofa seating units do not detract from the overall shape of the assembled modular sofa.

It is an object of the present invention to provide a modular sofa wherein table units provide storage space, and at multiple levels, together with a table which coordinates with the shape, structure and the look of the adjacent seating units.

SUMMARY OF THE PRESENT INVENTION

The present invention thus provides an improved modular sofa seating apparatus that includes a base support structure and a plurality of upholstered seating units disposed upon the base support structure, each with a seating surface having a rear edge.

A plurality of upholstered seat back portions extends upwardly from the seating surface rear edge and terminates at an upper edge portion.

At least one wedge-shaped member is positioned between adjacent seating surfaces, each wedge-shaped member including a pair of angularly intersecting edge portions and a rear portion that defines the edges of each wedge-shaped member.

The wedge-shaped members have a table with a surface that extends between the edge portions. An upholstered portion extends upwardly from the table surface, approaching the upper surface of the seat back portions and the edge portions of the wedge member define an acute angle of about forty-five degrees (45°).

In the preferred embodiment, the wedge-shaped member includes a pair of spaced apart table surfaces that are positioned at different elevations.

The modular sofa seating apparatus of the present invention can include a pair of wedge-shaped members disposed in the sofa sectional seating arrangement with one or more seating units in between the two wedge-shaped members.

In the preferred embodiment, the modular sofa seating apparatus of the present invention includes a pair of adjoining wedge-shaped members positioned between or adjacent one or more seating units.

In the preferred embodiment, the wedge-shaped member provides a lowermost table surface having a storage area under the table surface.

In the preferred embodiment, the wedge-shaped member provides a base that extends downwardly to engage an underlying support surface such as a floor, the base defining a storage area under the lowermost table surface.

In the preferred embodiment, the upholstered surface portion of the wedge member includes an inclined portion that extends above the table surfaces.

In the preferred embodiment, there are a pair of table surfaces at differing elevations, and the lowermost table surface includes a portion that hingedly affixes to the wedge-shaped member so that a portion of the lowermost table surface pivots upwardly to an opened position to reveal a storage area thereunder.

BRIEF DESCRIPTION OF THE DRAWINGS

For a further understanding of the nature and objects of the present invention, reference should be had to the following detailed description taken in conjunction with the accompanying drawings, in which like parts are given like reference numerals, and wherein.

DETAILED DESCRIPTION OF THE PREFERRED EMBODIMENT

Figure 1:
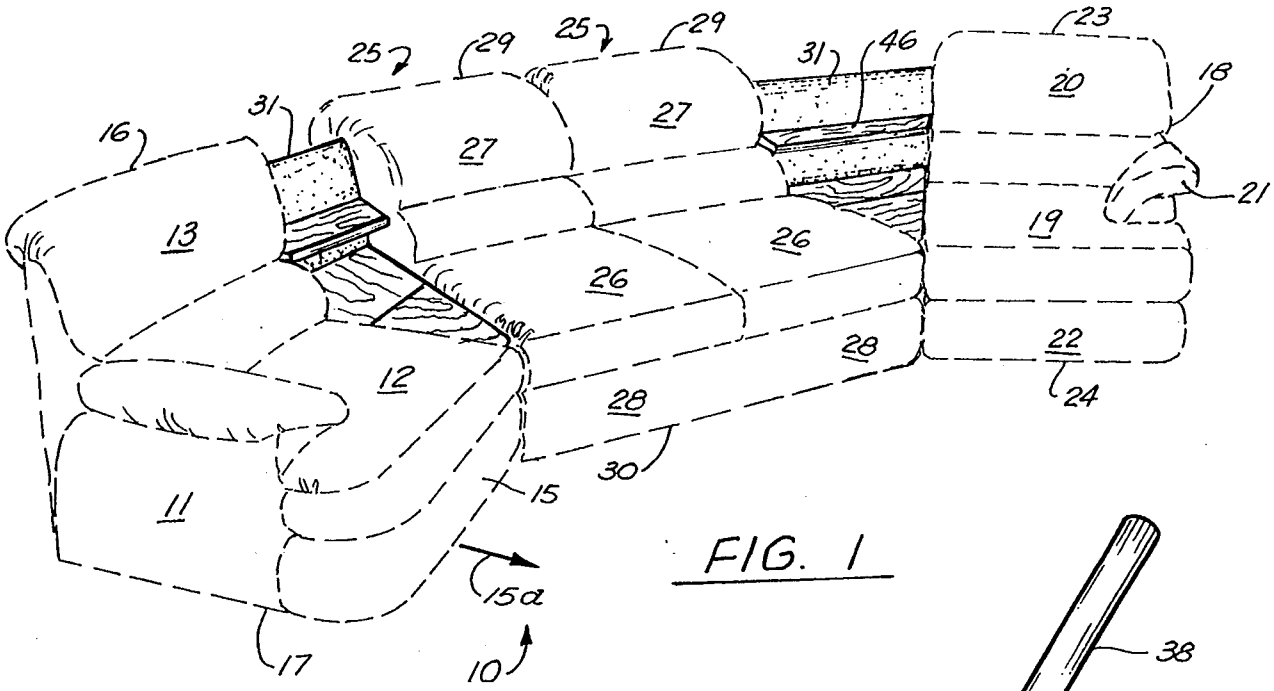
FIG. 1 is a perspective view of the preferred embodiment of the apparatus of the present invention.

FIG. 1 illustrates generally the preferred embodiment of the apparatus of the present invention designated generally by the numeral 10.

Modular sofa 10 includes multiple seating units such as for example, reclining seating units 11, 18 and armless chair units 25. Recliner 11 is an upholstered furniture seating unit that includes an upholstered seat cushion 12 and upholstered seat back 13, and upholstered arm portion 14, and having an upholstered kick panel footrest or ottoman 15. A user can recline the seat back 13 portion of recliner 11 if desired and the ottoman 15 can move outwardly to provide a seat rest for the user in the reclining position. Recliners 11 and recliner mechanisms are commercially available seating units. Arrow **15*a* in FIG. 1 illustrates generally the direction of movement of ottoman 15** when moving from a seating position to a reclining position.

Recliner seating unit 18 is positioned opposite recliner 11. Seating unit 11 also provides an upholstered seat cushion 19, upholstered seat back 20, upholstered arm 21, and an upholstered ottoman 22. Arrow **22*a* in FIG. 1 illustrates generally the movement of ottoman 22 between a seating and reclining position of recliner 18. A pair of armless chairs 25 are shown in FIG. 1. Alternately, a sofa or love seat can be positioned in place of the two armless chairs 25 of FIG. 1**.

Armless chairs 25 each provide an upholstered seat cushion 26, and upholstered back 27, a vertically and laterally extending kick panel 28, and a top surface 29. Each armless chair 25 provides a base 30 that abuts the underlying ground surface or floor.

In FIGS. 3–6, wedge tables 31 are illustrated. Tables 31 can be positioned between the recliners and armless chairs as shown. Thus, a wedge table 31 is positioned between recliner unit 11 and armless chair 25. Similarly, wedge table 31 is positioned between recliner 18 and armless chair 25.

Each wedge table 31 provides a base 32, front edge portion 33, and wherein the wedge table 31 includes table side edge portions 35, 36 that form an acute angle of preferably forty-five (45°) degrees. A wedge table base 32 is preferably upholstered providing flat sides that similarly are positioned at the same acute angle with respect to each other as the side edges 35, 36 of table surface 34. Table rear edge 37 communicates with the bottom of vertical upholstered portion 43. The edge 37 communicates with the bottom of inclined front surface 44 of vertical upholstered portion 43.

First table surface 34 is preferably formed of two table segments 38, 39. Front table segment 38 is preferably movable, being hingedly mounted upon hinge 40 to wedge table 31. Upon movement of table segment 38 to an open position, a storage area 41 is revealed. The storage area can be used to store a telephone, books, video tapes and the like. Table segment 38 is thus triangularly shaped. Table segment 39 is trapezoidally shaped, extending from hinge 40 rearwardly to table rear edge 37.

Vertical upholstered portion 43 includes a top edge portion 45 which closely approximates the top surface 29 of armless chairs 25 and the top surfaces 16, 23 respectively of recliners 11, 18.

An upper table 46 is positioned at an elevation above first table surface 34. Upper table 47 thus provides a flat surface 47 for carrying a reading lamp and/or for displaying articles such as artwork, photographs, floral arrangements and the like. Upper table 46 thus provides a front edge portion 48, a pair of side edges 49, 50 and a rear edge 51.

Figure 6:
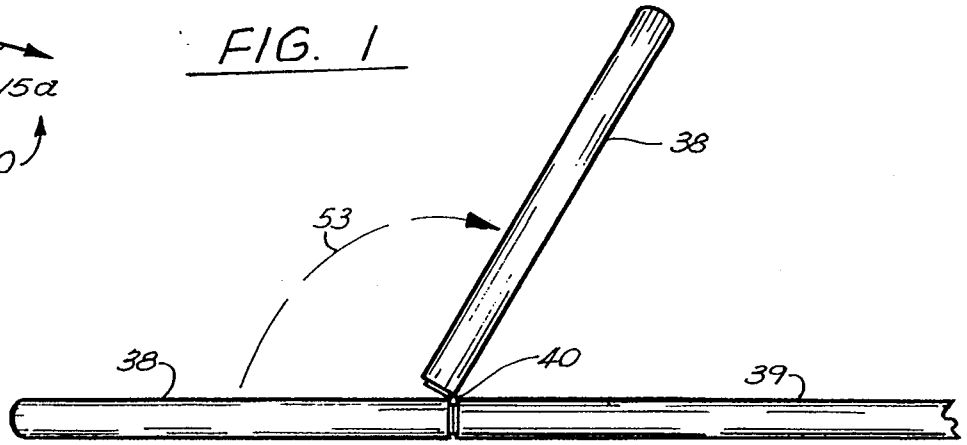
FIG. 6 is a fragmentary view of the preferred embodiment of the apparatus of the present invention illustrating the wedge-shaped table portion thereof.
Figure 2:
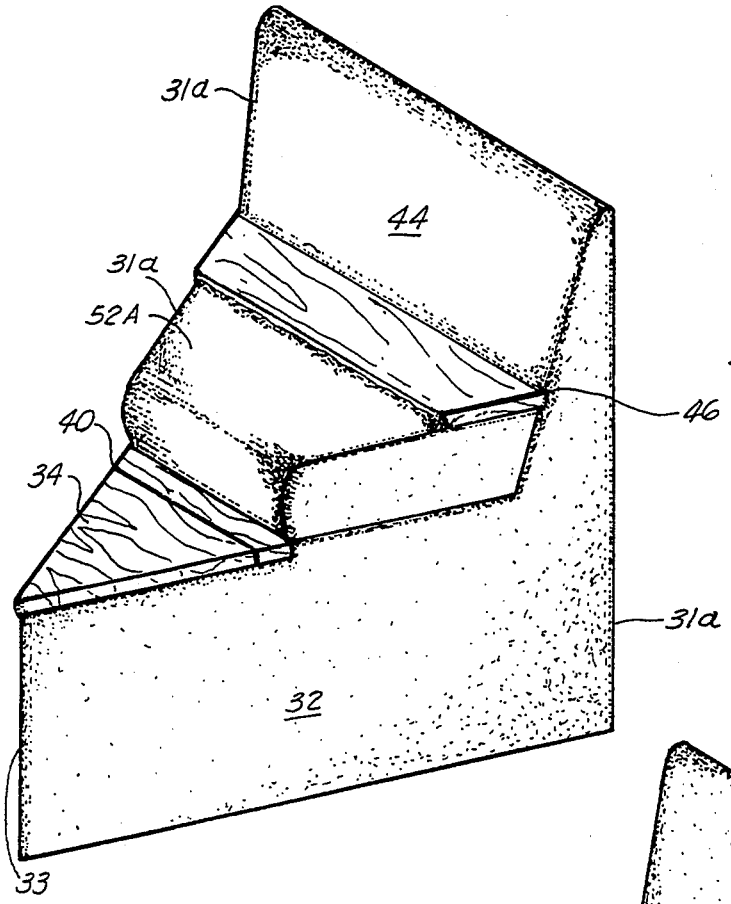
FIG. 2 is a partial perspective view of the preferred embodiment of the apparatus of the present invention illustrating the wedge table portion thereof.
Figure 3:
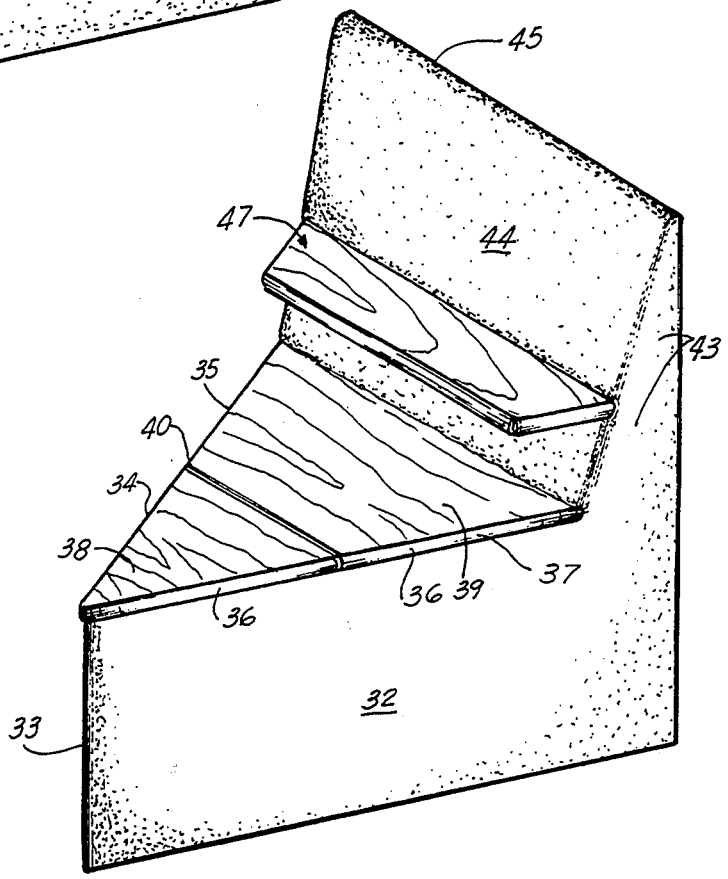
FIG. 3 is a partial perspective view of a second embodiment of the apparatus of the present invention illustrating the wedge table portion thereof.
Figure 4:
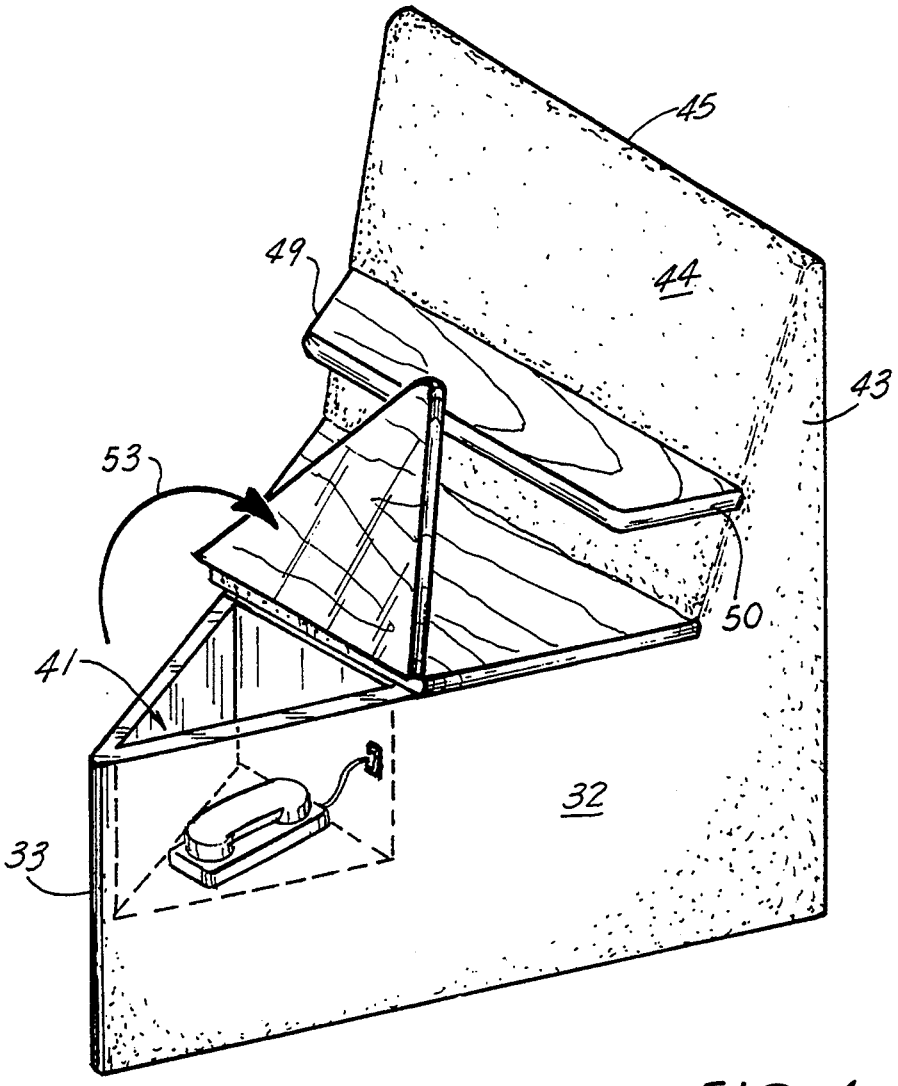
FIG. 4 is a partial perspective view of the preferred embodiment of the apparatus of the present invention illustrating the wedge table portion thereof with the table opened to illustrate the storage area portion thereof.
Figure 5:
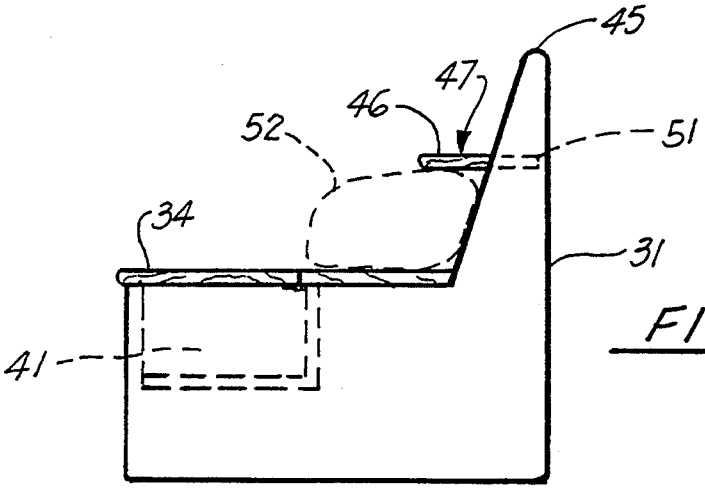
FIG. 5 is a sectional fragmentary view of the preferred embodiment of the apparatus of the present invention illustrating the wedge table portion thereof.

A space is provided under upper table 47 for the storage of a cushion 52 which can be used as an armrest for the user. An alternate construction (FIG. 2) designated as table **31*a* provides a built-in cushion 52A. Arrow 53 in FIGS. 4 and 6 illustrate the opening and closing of table segment 38 for obtaining access to storage area 41**.

The following table lists the part numbers and part descriptions as used herein and in the drawings attached hereto.

TABLE 1

PARTS LIST

| PART NO. | DESCRIPTION |
|---|---|
| 10 | modular sofa |
| 11 | recliner seating unit |
| 12 | seat cushion |
| 13 | seat back |
| 14 | arm |
| 15 | ottoman |
| 15a | arrow |
| 16 | top surface |
| 17 | base |
| 18 | recliner seating unit |
| 19 | seat cushion |
| 20 | seat back |
| 21 | arm |
| 22 | ottoman |
| 22a | arrow |
| 23 | top surface |
| 24 | base |
| 25 | armless chair |
| 26 | seat cushion |
| 27 | seat back |
| 28 | kick panel |
| 29 | top surface |

TABLE 1-continued

| PARTS LIST | |
|---|---|
| PART NO. | DESCRIPTION |
| 30 | base |
| 31 | wedge table |
| 31a | wedge table |
| 32 | base |
| 33 | front edge |
| 34 | first table surface |
| 35 | table side edge |
| 36 | table side edge |
| 37 | table rear edge |
| 38 | table segment |
| 39 | table segment |
| 40 | hinge |
| 41 | storage area |
| 42 | rear surface |
| 43 | vertical upholstered portion |
| 44 | inclined front surface |
| 45 | top edge |
| 46 | upper table |
| 47 | surface |
| 48 | front edge |
| 49 | side edge |
| 50 | side edge |
| 51 | rear edge |
| 52 | removable cushion |
| 52A | cushion |
| 53 | arrow |

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A modular sofa seating apparatus comprising, a) a plurality of upholstered seating units, each having a base and a seating surface having a seating surface rear edge;

b) a plurality of upholstered seat back portions, each extending upwardly from a respective seating surface rear edge and terminating at a seat back upper edge portion; and c) at least one wedge shaped member positioned between adjacent seating surfaces, each wedge shaped member including:

i) a pair of angularly intersecting upholstered edge portions and a rear portion that define the edges of each wedge shaped member, ii) a flat table having a table surface extending between the edge portions, iii) a vertically extended upholstered portion that extends upwardly from the table surface and having an upper edge that approaches the seat back upper edge portions, d) wherein the intersecting edge portions define an acute angle of about forty-five degrees.

2. The apparatus of claim 1 wherein there are at least two of the wedge shaped members.

3. The apparatus of claim 1 wherein there are at least two spaced apart wedge shaped members.

4. The apparatus of claim 1 wherein each of the wedge shaped members has a storage area under the table surface.

5. The apparatus of claim 1 wherein at least one of the wedge shaped members has two table surfaces at different elevations and there is a hidden storage area under one of the table surfaces.

6. The apparatus of claim 1 wherein each of the wedge shaped members has an upper table surface, a lower table surface, and a storage area below the lower table surface, and the lower table surface has a movable portion that is movable to reveal the storage area thereunder.

7. The apparatus of claim 1 wherein the vertically extended upholstered portion of the wedge shaped member is inclined.

8. The apparatus of claim 7 wherein the vertically extended upholstered portion of the wedge shaped member includes a portion that extends above the table surface.

9. The apparatus of claim 1 wherein each wedge shaped member includes a lower table portion and an upper table portion vertically spaced from the lower table portion, the lower table portion has a triangularly shaped surface, and the upper table portion has a trapezoidally shaped surface.

10. The apparatus of claim 9 wherein the lower table portion is hingedly attached to the wedge shaped member.

11. The apparatus of claim 1 wherein at least one of the wedge shaped members has a pair of table surfaces at differing elevations.

12. The apparatus of claim 2 wherein one of the table surfaces has a space thereunder.

13. A modular sofa seating apparatus comprising:

a) a plurality of upholstered seating units, each seating unit including a seating surface having a seating surface rear edge;

b) a plurality of upholstered seat back portions, each extending upwardly from a respective seating surface rear edge, and terminating at an upper edge portion; and c) at least one generally wedge shaped member positioned adjacent at least one of the seating units, each wedge shaped member including:

i) a pair of angularly intersecting vertical sides, and a rear portion, ii) a flat table surface extending between the vertical sides and the rear portion, iii) the rear portion including an upholstered, vertically extended portion extending upwardly above the table surface and approaching an elevational position near that of the upper edge portion of the seat back portions, d) wherein the vertical sides define an acute angle.

14. A modular sofa seating apparatus comprising:

a) a plurality of upholstered seating units, each having a base and a seating surface having a seating surface rear edge;

b) a plurality of upholstered seat back portions, each extending upwardly from a respective seating surface rear edge and terminating at a seat back upper edge portion;

c) at least one wedge shaped member positioned between adjacent seating surfaces, each wedge shaped member including:

i) a pair of angularly intersecting upholstered edge portions and a rear portion that define the edges of each wedge shaped member, ii) a flat table having a table surface extending between the edge portions, iii) a vertically extended upholstered portion that extends upwardly from the table surface and having an upper edge that approaches the seat back upper edge portions, d) wherein the intersecting edge portions define an acute angle of about forty-five degrees;

e) wherein there are a lower table portion and an upper table portion vertically spaced from the lower table portion on each wedge shaped member, the lower table portion has a triangularly shaped surface, and the upper table portion has a trapezoidally shaped surface; and f) wherein the upper table portion extends partially over the lower table portion.

15. A modular sofa seating apparatus comprising:

a) a plurality of upholstered seating units each having a base and a seating surface with a rear edge;

b) a plurality of vertically extending upholstered seat back portions, each extending upwardly from a respective seating surface rear edge and terminating at a seat back upper edge portion; and c) at least two wedge shaped members positioned between adjacent seating surfaces, each wedge shaped member including:

i) a pair of angularly intersecting edge portions and a rear edge portion, ii) a flat table surface extending between the edge portions, iii) an upholstered vertically extending portion extending upwardly from the table surface and having an upper edge that approaches the seat back upper edge portion, d) wherein the intersecting edge portions define an acute angle.

16. The apparatus of claim 15 wherein at least two of the wedge shaped members are spaced apart.

17. The apparatus of claim 15 wherein each of the wedge shaped members has a storage area under the table surface.

18. The apparatus of claim 15 wherein at least one of the wedge shaped members has two table surfaces at different elevations, and further comprising a hidden storage area under the lower table surface.

19. The apparatus of claim 15 wherein there are a pair of table surfaces on each of the wedge shaped members and of different elevations, and further comprising a storage area, and the lower table surface has a movable portion that is movable to reveal the storage area thereunder.

20. The apparatus of claim 15 wherein each wedge shaped member has a lower, triangularly shaped table portion and an upper trapezoidally shaped table portion, and wherein the triangularly shaped table portion of each wedge shaped member includes a portion that hingedly attaches to its respective wedge shaped member.

21. The apparatus of claim 15 wherein at least one of the wedge shaped members has a pair of table surfaces at differing elevations.

22. The apparatus of claim 21 wherein one of the table surfaces has a space thereunder.

23. A modular sofa seating apparatus comprising:

a) a plurality of upholstered seating units each having a base and a seating surface with a rear edge;

b) a plurality of vertically extending upholstered seat back portions, each extending upwardly from a respective seating surface rear edge and terminating at a seat back upper edge portion;

c) at least two wedge shaped members positioned between adjacent seating surfaces, each wedge shaped member including:

i) a pair of angularly intersecting edge portions and a rear edge portion, ii) a flat table surface extending between the angularly intersecting edge portions, and the rear edge portion, iii) an upholstered vertically extending portion extending upwardly from the table surface and having an upper edge that approaches the seat back upper edge portion, d) wherein the intersecting edge portions define an acute angle;

e) wherein each wedge shaped member includes a lower, triangularly shaped table portion and an upper trapezoidally shaped table portion;

f) wherein the triangularly shaped table portion of each wedge shaped member includes a portion that hingedly attaches to its respective wedge shaped member; and g) wherein the upper table portion extends partially over the lower table portion.

24. The apparatus of claim 23 wherein:

the portion of the triangularly shaped table portion which hingedly attaches to the wedge shaped member is hingedly attached to the wedge shaped member with a hinge;

the upper table portion has a front edge portion; and the hinge is positioned generally below the front edge portion of the upper table portion.

25. A modular sofa seating apparatus comprising:

a) a plurality of upholstered seating units, each seating unit having a seating surface with a seating surface rear edge;

b) a plurality of upholstered seat back portions, each extending upwardly from a respective seating surface rear edge and terminating at an upper edge portion; and c) a generally wedge-shaped member positioned adjacent at least one of the seating units, the wedge-shaped member including:

i) a pair of generally vertically extending side portions, ii) a rear portion that extends between the side portions, iii) a flat table surface extending between the side portions and the rear portion, iv) an upholstered vertically extending portion extending upwardly, above the table surface and having an upper surface that approaches the upper edge portions of the seat back portions, d) wherein the side portions define an acute angle.

26. The apparatus of claim 25 wherein there are at least two of the wedge-shaped members.

27. The apparatus of claim 25 wherein there are at least two spaced apart wedge-shaped members.

28. The apparatus of claim 25 wherein the wedge-shaped member is provided with a storage area under the table surface.

29. The apparatus of claim 25 wherein there are two table surfaces at different elevations and there is a hidden storage area under one of the table surfaces.

30. The apparatus of claim 25, wherein there are a pair of table surfaces on the wedge-shaped member and of different elevations, there is a storage area under the lower table surface, and the lower table surface has a forward portion that is movable to reveal the storage area thereunder.

31. The apparatus of claim 25, wherein the upholstered portion of the wedge-shaped member includes an inclined portion that extends above the table surface.

32. The apparatus of claim 25 wherein the upholstered portion of the wedge-shaped member includes a portion that extends above the table surface to the upper surface, and a lower kick portion that extends downwardly from the table surface.

33. The apparatus of claim 25 wherein the wedge-shaped member includes two vertically spaced table surface portions, and one of the table surface portions is of a trapezoid shape.

34. The apparatus of claim 25 wherein the wedge-shaped member has a pair of horizontal table surfaces supported at different elevations.

35. The apparatus of claim 34 wherein one of the table surfaces has a space thereunder.

* * * * *